US005632081A

United States Patent [19]

Gerhard, Jr.

[11] Patent Number: 5,632,081

[45] Date of Patent: May 27, 1997

[54] TWO STEP TAB CRIMPER AND WIRE INSERTER

[75] Inventor: George H. Gerhard, Jr., Laureldale, Pa.

[73] Assignee: The Whitaker Corporation, Wilmington, Del.

[21] Appl. No.: 503,117

[22] Filed: Jul. 17, 1995

[51] Int. Cl.[6] ..... H01R 43/045; H01R 43/055

[52] U.S. Cl. ..... 29/751; 29/564.4; 29/566.4; 29/753; 29/866; 72/409.06; 72/409.14

[58] Field of Search ..... 29/33 M, 564.4, 29/566.4, 751, 753, 863, 866; 7/107; 72/409.06, 409.14, 412, 469

[56] References Cited

U.S. PATENT DOCUMENTS

| | | | |
|---|---|---|---|
| 3,820,055 | 6/1974 | Huffnagle et al. | 439/400 |
| 4,225,990 | 10/1980 | Theiler, Sr. | 7/107 |
| 4,414,740 | 11/1983 | Nijman | 29/751 |
| 4,870,747 | 10/1989 | Maack et al. | 29/866 X |
| 4,991,289 | 2/1991 | French | 29/863 |
| 5,099,570 | 3/1992 | Gerhard, Jr. | 29/751 |
| 5,375,317 | 12/1994 | Murakami et al. | 29/753 |
| 5,432,995 | 7/1995 | Takenami et al. | 29/753 |
| 5,457,876 | 10/1995 | Gerhard, Jr. | 29/566.4 X |
| 5,484,961 | 1/1996 | Itoh et al. | 29/863 X |

FOREIGN PATENT DOCUMENTS

| | | | |
|---|---|---|---|
| 2711848 | 10/1993 | France | H01R 4/24 |
| 3937029 | 3/1991 | Germany | 29/753 |
| 6140121 | 5/1994 | Japan | 29/753 |

*Primary Examiner*—Peter Vo

[57] ABSTRACT

A tool (30) is disclosed for inserting insulated conductors (32) into insulation displacement contacts (34) and crimping the strain relief tabs (76) onto the insulated conductor in two stages to minimize distortion of the housing (36) containing the contacts. The tool includes an inserter (48) having a first crimping blade (70) that operates in a first crimping station (86) and a second crimping blade (88) that operates in a second crimping station (102). The inserter (48) includes an insertion blade (66) that fully inserts the insulated conductor (32) in the IDC contact (34) in the first crimping station (86) while the first crimping blade 70 rolls over and partially crimps the tabs (76) that project from the contact (34) onto the insulated conductor (32). Concurrently, the second crimping blade 88 engages the tabs (76) in the second crimping station 102 and completes the crimp to form the strain relief.

17 Claims, 7 Drawing Sheets

TWO STEP TAB CRIMPER AND WIRE INSERTER

The present invention relates to apparatus for inserting insulated conductors into insulation displacement contacts and crimping the strain relief tabs onto the insulated conductor in two stages to minimize distortion of the housing containing the contacts.

BACKGROUND OF THE INVENTION

Connectors having insulation displacement contacts (IDC) are widely used in the telephone and computer industries as well as in other industries. Such an IDC connector, for example, is disclosed in U.S. Pat. No. 3,820,055 which issued Jun. 25, 1972 to Hufnagle. In line with the miniaturization trend in the manufacture of electronic and electrical components, these IDC connectors are beginning to be made quite small with closely space contacts. The insulated housings of these connectors have relatively thin wall sections that are delicate and easily deformed or damaged. When terminating insulated conductors to these connectors, tabs on each of the contacts must be crimped onto the insulation of its respective conductor to form a strain relief. This crimping process tends to bulge the crimped area outwardly against the wall sections of the housing that separate the contacts. A wall section can be deformed or bent over into the area of an adjacent contact that has not yet received a conductor so that, when termination of a conductor is attempted the insertion tooling may engage this deformed wall section and damage the connector. This is illustrated in FIGS. 1 and 2 where there is shown a connector 10 having a series of insulation displacement contacts 12 positioned in a tool 14. The tool includes an inserter 16 that both inserts the conductor into the contact 12 and rolls over and crimps a pair of tabs 18 that project upwardly from each contact, to form a strain relief in the usual manner. Each contact 12 is separated by a relatively thin insulating wall 20 that is part of the connector housing. During the insertion operation the crimped area of the contact 12 tends to bulge out in the horizontal direction, as shown at 22 in FIG. 1. While the end wall 24 is relatively thick and rigid, the opposite wall 20 in the first contact cavity is relatively thin and deflects toward the right a small amount under the pressure of the crimped first contact. In the case of a relatively shallow crimping depth this deflection of the wall 20 is only slight in the first couple of contacts, however, when the third contact is crimped, as shown in FIG. 1, the effect of cumulative side pressure caused by the bulging of the first several contacts causes a significant deflection of the wall 26 into the fourth contact cavity. When the connector 10 is indexed to the fourth cavity, the inserter may engage the edge of the wall 26, as shown in FIG. 2, resulting in damage to the connector 10 or the tool 14. In the case where the crimping depth is relatively greater, the wall 26 can be significantly deflected after only the first contact is fully crimped so that the wall intrudes well into the cavity of the second contact. In this case, when the connector 10 is indexed to the second cavity, the inserter may engage the wall 26.

What is needed is an apparatus for terminating such IDC connectors while assuring that the inserter does not damage the walls of the connector housing.

SUMMARY OF THE INVENTION

An apparatus is disclosed for terminating a plurality of insulated conductors to a plurality of insulation displacement contacts arranged side by side in an insulating connector housing. The connector housing includes a wall between each two adjacent contacts. Each contact includes tabs to be crimped onto the insulation of a respective insulated conductor thereby forming a strain relief for the conductor. Tooling is provided for performing the termination operation, including a first member in a first station for at least partially inserting a first insulated conductor into a first contact and for only partially crimping the tabs of the first contact onto the insulation of the first insulated conductor. The tooling includes means for moving the connector housing so that the first contact and the first insulated conductor are moved to a second station and a second contact and second insulated conductor are moved into the first station. A second member in the second station is provided for engaging and further crimping the partially crimped tabs of the first contact.

DESCRIPTION OF THE PREFERRED EMBODIMENT

Figure 1:
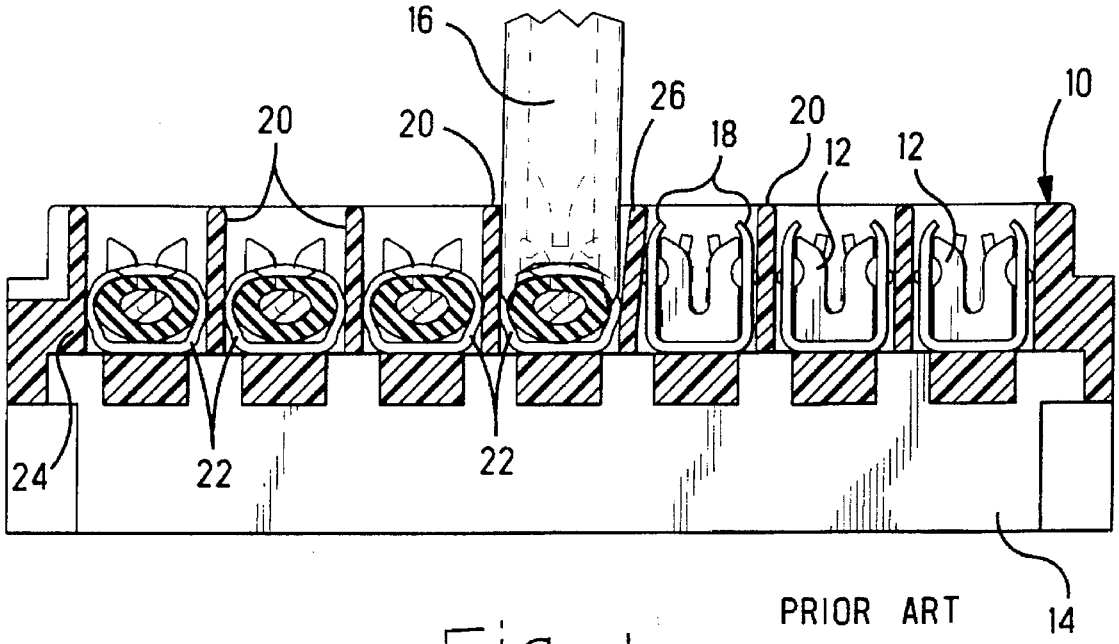
PRIOR ART Fig. 1
FIG. 1 is a schematic representation of an IDC connector being terminated by a prior art insertion tool.
Figure 2:
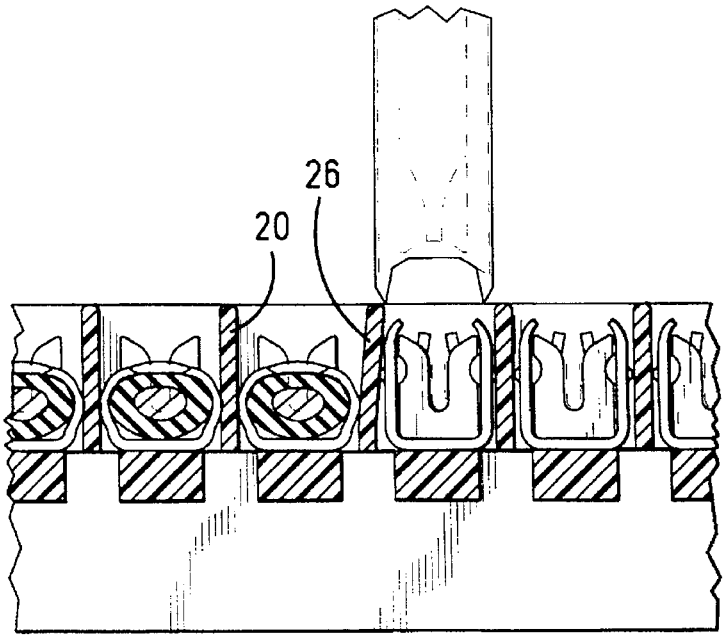
PRIOR ART Fig. 2
FIG. 2 is a view similar to that of FIG. 1 showing the potential problem addressed by the present invention.
Figure 3:
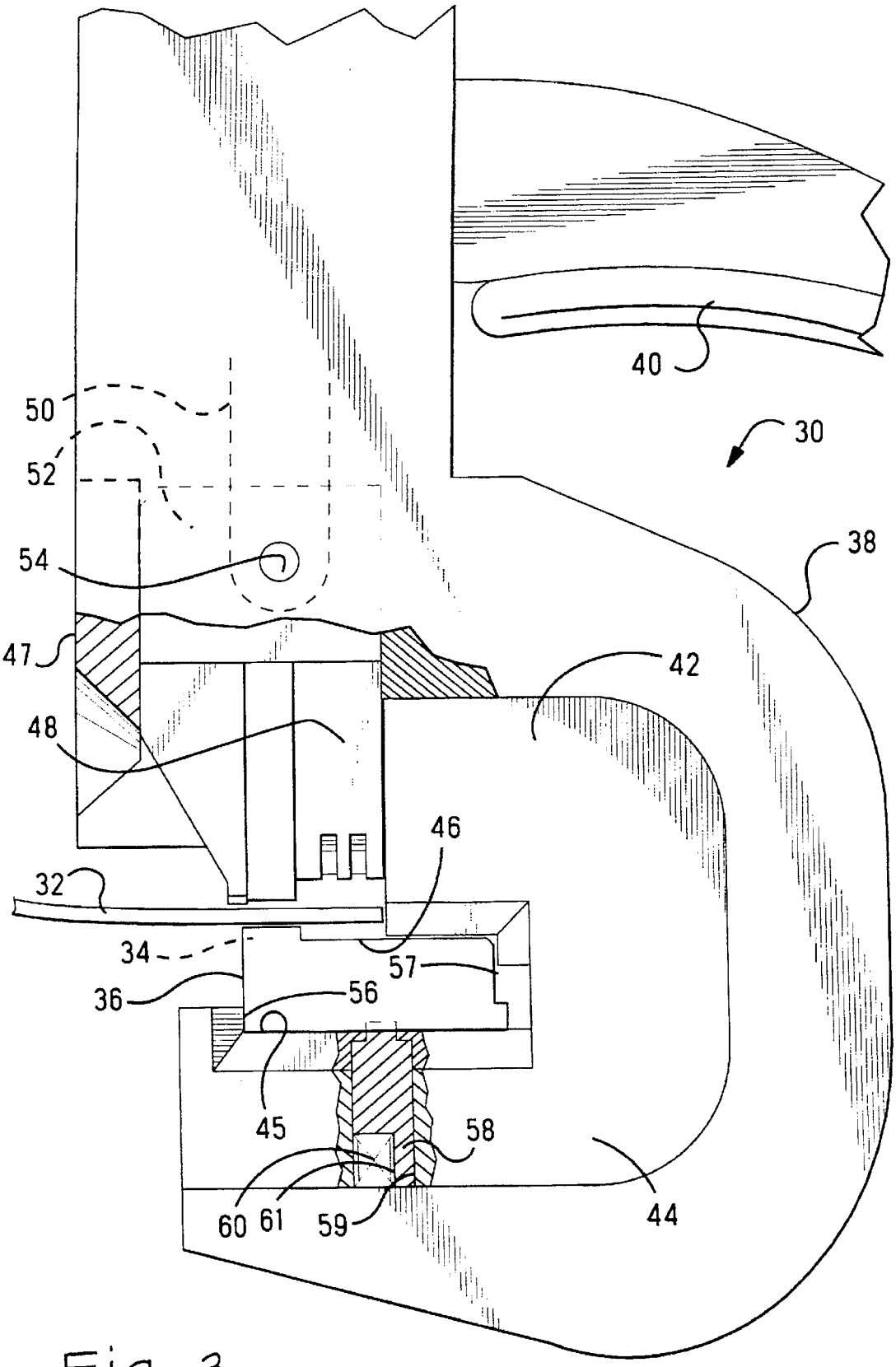
FIG. 3 is a side view of a hand tool incorporating the teaching of the present invention.
Figure 5:
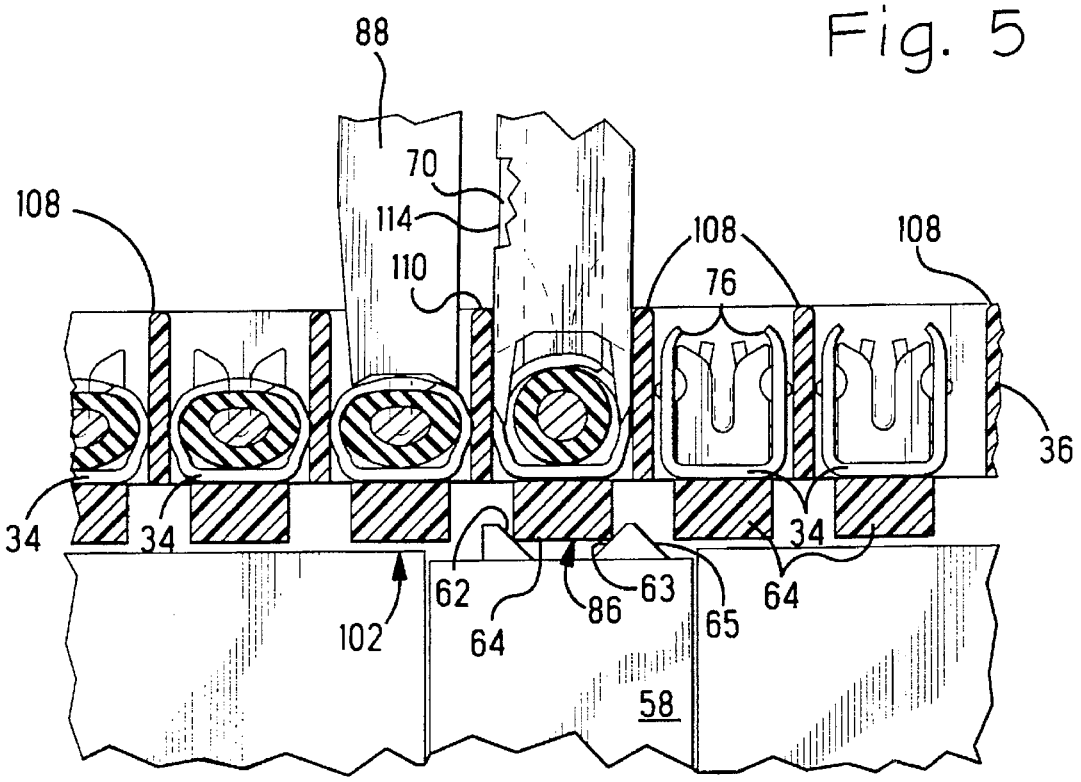
FIG. 5 is an enlarged view of a portion of the view shown in FIG. 4.
Figure 5A:
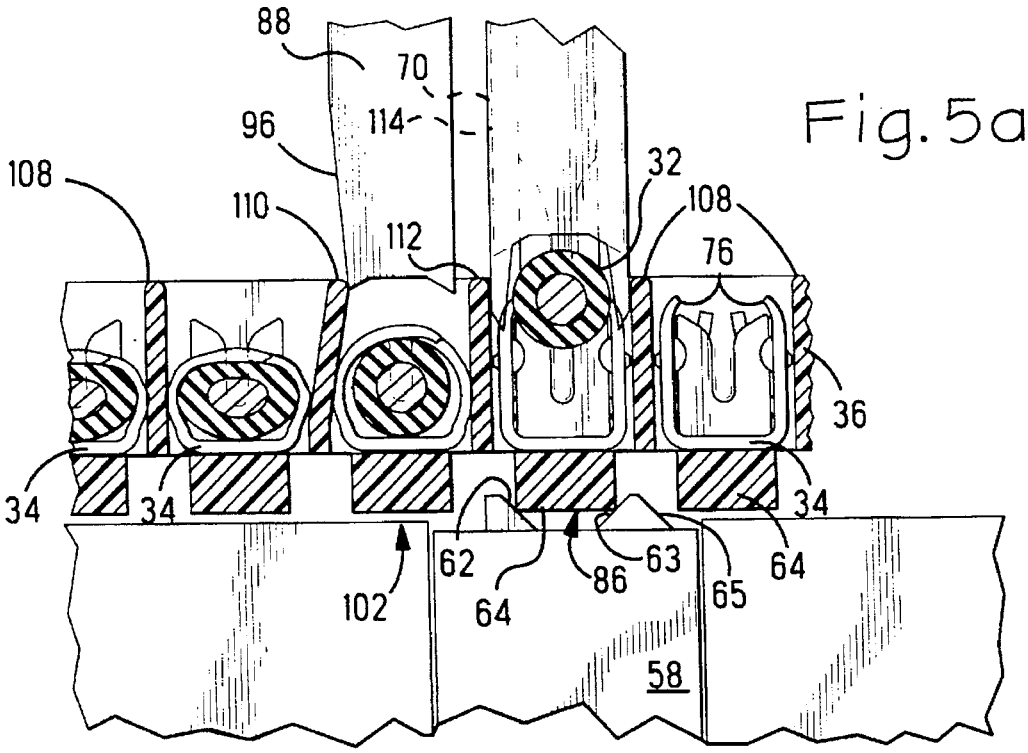
FIG. 5A is a view similar to that of FIG. 5 showing the connector housing advanced one position.

There is shown in FIG. 3 a hand tool 30 for inserting an insulated conductor 32 into an insulation displacement contact (IDC) 34 in a connector housing 36. The hand tool 30 includes a frame 38 and a manually actuated handle 40. A tooling module 42 is positioned within the frame 38 as shown in FIGS. 1 and 2. The tooling module 42 includes a C-shaped base 44, a track 45 for receiving the connector housing 36, and an inserter 48 positioned within a slot formed within a wire guide 47 that is attached to the tool 30. The inserter 48 is arranged to undergo reciprocating motion toward and away from the connector housing 36. A ram 50 actuated by the handle 40, is attached to the shank 52 of the inserter 48 by means of the pin 54. By manually actuating the handle 40, the ram 50 causes the inserter 48 to undergo reciprocating motion toward and away from the connector housing 36. The track 45 includes a top surface 46 on the wire guide 47, and a forward surface 56 and a rear surface 57 on the base 44, that confine the connector housing 36. A locating pawl 58 is arranged to slide vertically in an opening 59 formed in the base 44. A spring 60 is arranged in a cutout 61 in the lower portion of the locating pawl, as viewed in FIG. 3, to urge the locating pawl upwardly toward the connector housing 36. A pair of opposing angled surfaces 62 and 63 engage features 64 on the bottom of the connector housing 36 to bring a selected contact 34 into alignment with the inserter 48, as best seen in FIGS. 5 and 5A. Another angled surface 65 is formed facing in the opposite direction to that of the angled surface 63, as best seen in FIG. 5. This surface 65 serves as a camming surface so that when the connector housing is indexed to the next position, one of the features 64 will engage the surface 65 and cam the locating pawl downwardly against the bias of the spring 60 so that the pawl moves out of locating engagement with the connector housing 36.

Figure 4:
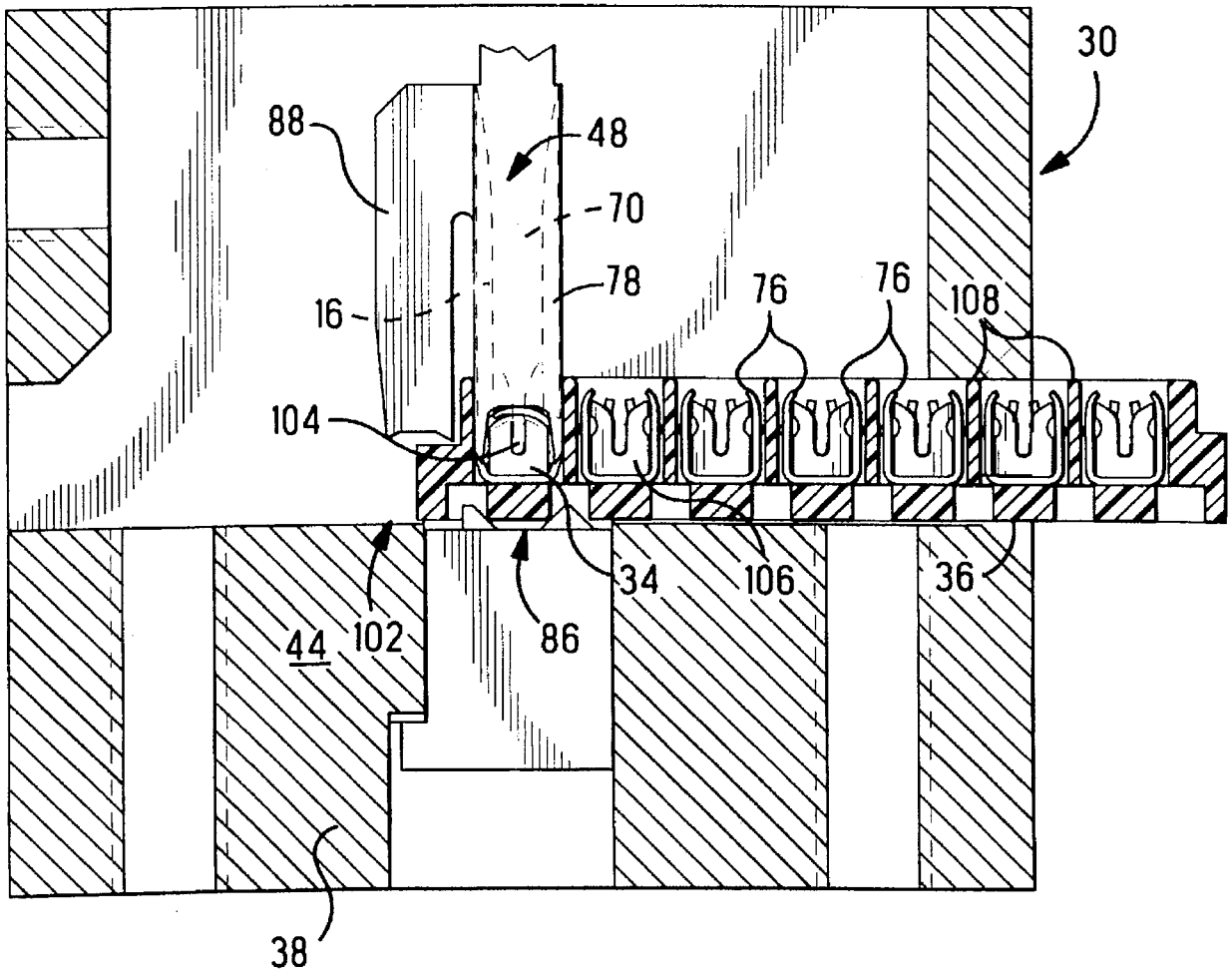
FIG. 4 is a front view of a portion of the tool shown in FIG. 3.
Figure 6:
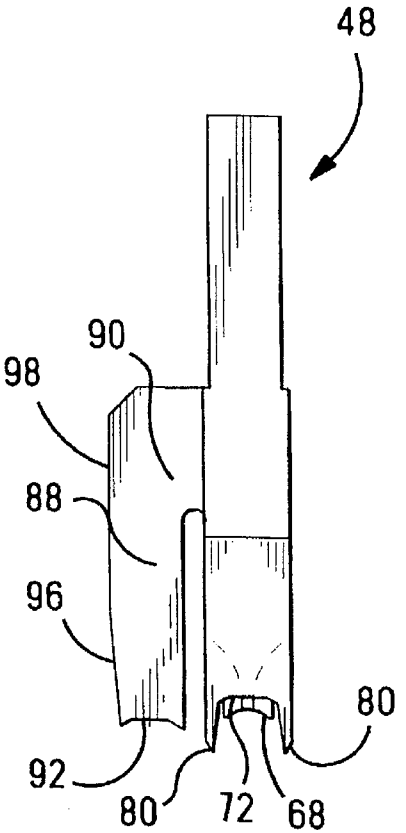
FIGS. 6, 7, and 8 are front, side, and rear views of the inserter shown in FIG. 3.
Figure 7:
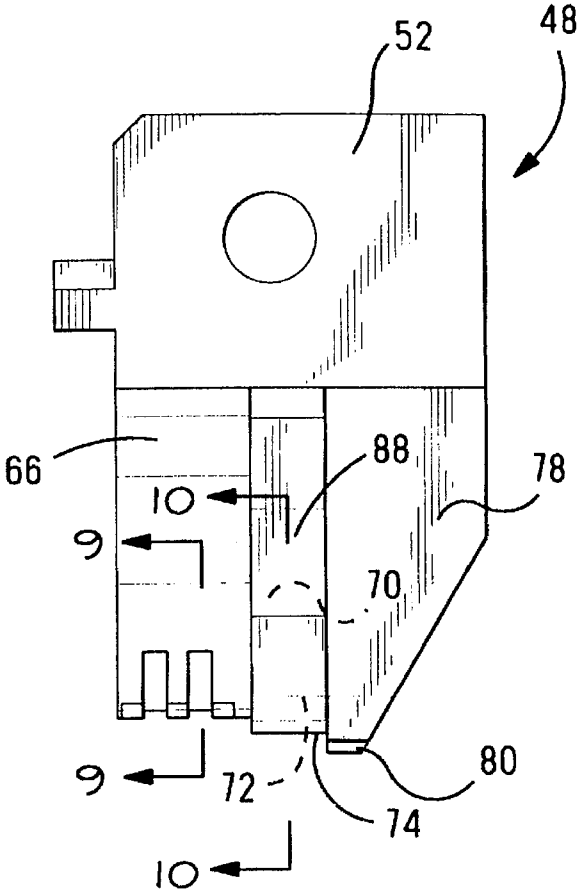
Figure 8:
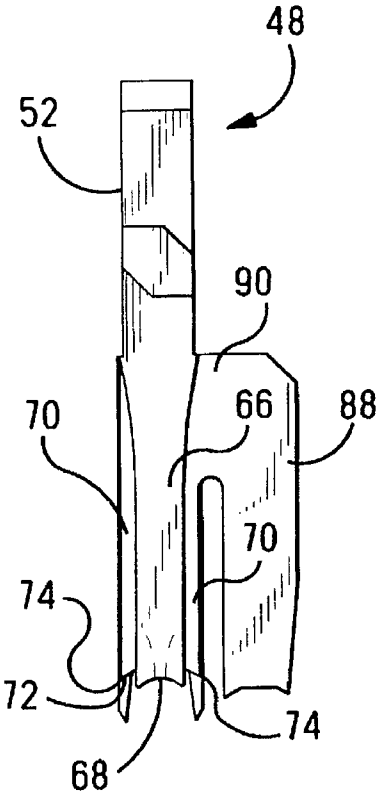
Figure 9:
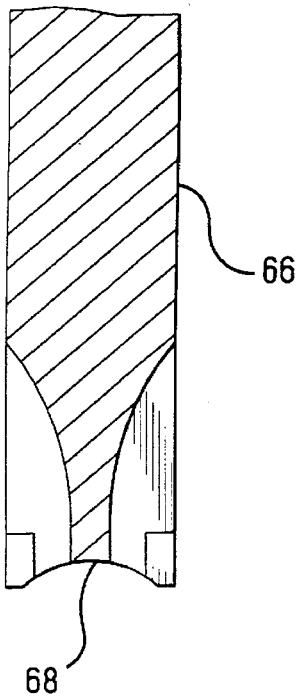
FIG. 9 is a cross-sectional view taken along the lines 9—9 in FIG. 7.
Figure 10:
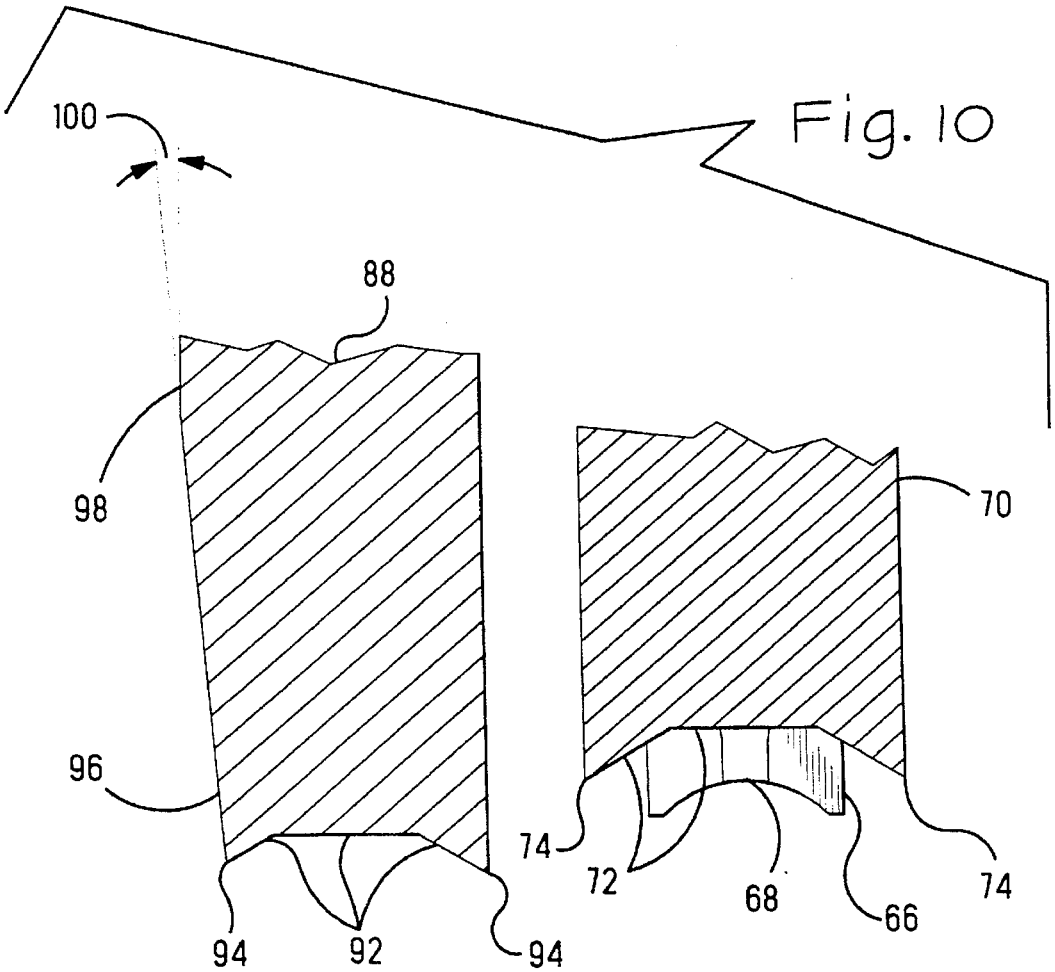
FIG. 10 is a cross-sectional view taken along the lines 10—10 in FIG. 7.

As shown in FIGS. 6, 7, and 8, the inserter 48 includes an insertion blade 66 having the usual cross-sectional shape and a wire engaging and insertion surface 68. A first crimping blade 70 is attached to the shank 52 adjacent the insertion blade 66, as shown in FIG. 7, and has a crimping surface 72, as best seen in FIG. 10. The crimping surface 72 terminates in somewhat sharp edges 74. The first crimping blade 70 is used in a first crimping station 86 of the tool 30, as best seen in FIG. 4, to roll over and partially crimp tabs 76 to the insulated conductor 32 in the formation of a strain relief. As is usual, the tabs 76 are formed as part of the IDC contact 34. A connector alignment member 78 is attached to the shank 52 adjacent the tab crimping blade 70, as shown in FIG. 7. The alignment member 78 includes a pair of camming surfaces 80 which are on opposite sides of the alignment member and extend further away from the shank 52 than do the crimping surface 72 and the inserting surface 68. The purpose of these camming surfaces 80 is to aid in more precise alignment of the connector housing 36 with respect to the inserter 48, as set forth in U.S. Pat. No. 5,009,570 which issued Mar. 31, 1992 to Gerhard, Jr. A second tab crimping blade 88 includes an offset portion 90 that is rigidly attached to the first crimping blade 70, as best seen in FIGS. 6, 7, and 8. The second crimping blade 88 includes a crimping surface 92 having a shape that is similar to the crimping surface 72, shown in FIG. 10. The crimping surface 92 terminates in somewhat sharp edges 94 similar to the edges 74. The second crimping blade 88 is arranged so that its crimping surface 92 extends further away from the shank 52 than does the crimping surface 72 and is used in a second crimping station 102 of the tool 30, as best seen in FIG. 4, to engage the tabs 76 that were partially crimped in the first crimping station 86 and complete the crimp. A shallow angled camming surface 96 is formed on an outside surface 98 of the second crimping blade 88 at an angle 100 of about 5 degrees, as best seen in FIG. 10, for a purpose that will be explained. The insertion blade 66, crimping blades 70 and 88, alignment member 78, and shank 52 are of unitary construction, in the present example, however, they may be separate parts suitably attached so that they reciprocate together when the handle 40 is actuated.

Figure 4A:
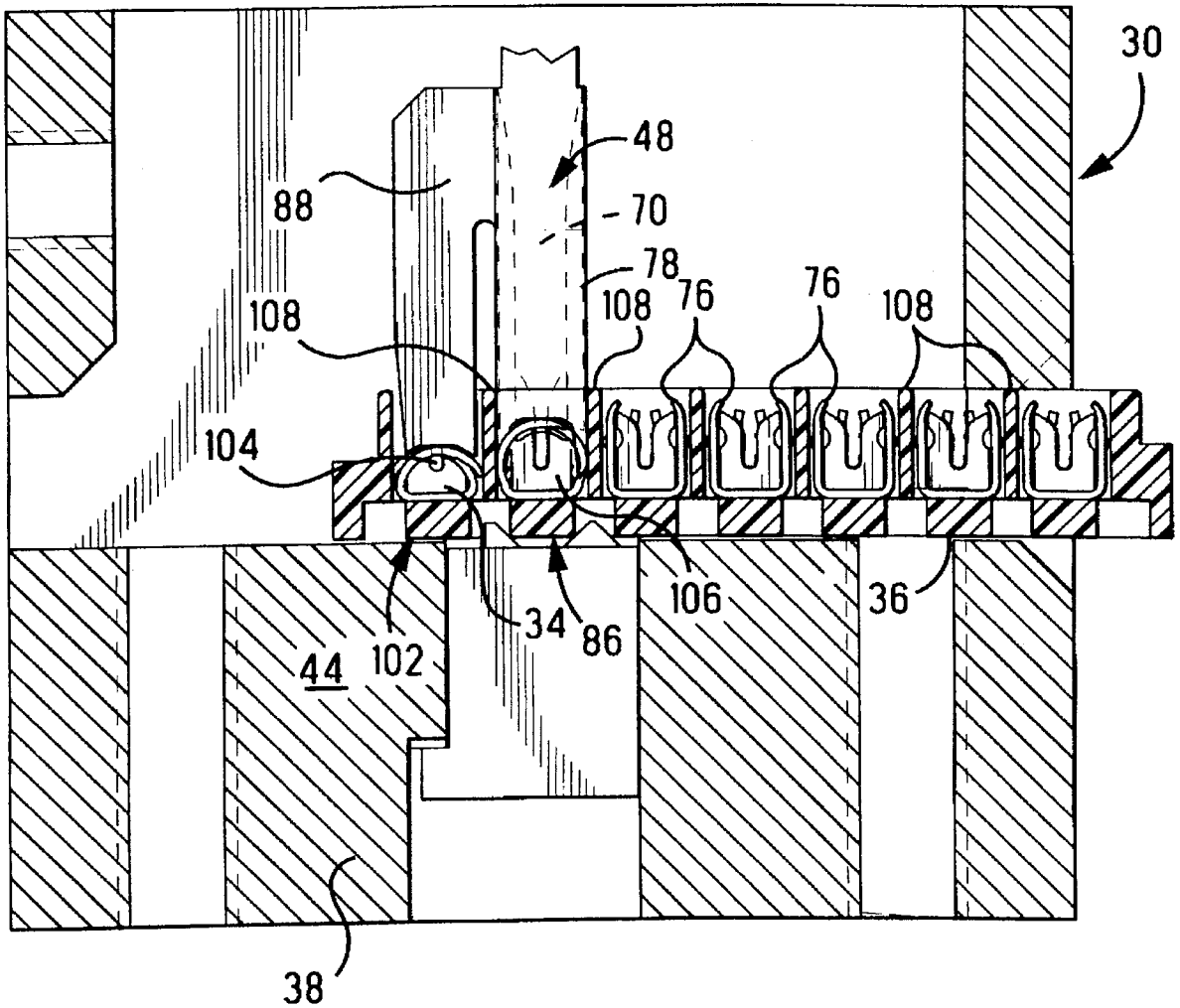
FIG. 4A is a view similar to that of FIG. 4 showing the connector housing advanced one position.

In operation, a connector housing 36 having several IDC contacts 34 therein, is positioned on the track 45 and the first contact cavity 104 aligned in the first crimping station 86. A first insulated conductor 32 is positioned in the first crimping station 86 and the handle 40 of the tool 30 actuated so that the inserter 48 is moved toward the base 44 and the insertion blade 66 fully inserts the first insulated conductor into the IDC contact 34 and the first crimping blade 70 rolls over the tabs 76 and partially crimps them around the first insulation of the insulated conductor, as shown in FIG. 4. The inserter 48 is then retracted and the connector housing 36 advanced one position to the left, as viewed in FIG. 4, so that the second contact cavity 106 is in the first crimping station 86 and the first contact cavity 104 is in the second crimping station 102. A second insulated conductor is positioned in the first crimping station 86 and the handle 40 of the tool 30 is again actuated so that the inserter 48 is moved toward the base 44. The insertion blade 66 fully inserts the second insulated conductor into the IDC contact 34 and the first crimping blade 70 rolls over the tabs 76 and partially crimps them around the insulation of the second insulated conductor, as shown in FIG. 4A. Concurrently, the second crimping blade 88 engages the partially crimped tabs 76 in the second crimping station 102 and completes the crimping operation so that a proper strain relief is formed, as shown in FIG. 4A. As shown in FIGS. 4 and 4A, adjacent contacts 34 are separated by relatively thin insulating walls 108. The crimping operation on the tabs 76 cause them to bulge outwardly in the horizontal direction so that they press against these walls 108. Each succeeding crimp has a cumulative effect so that after one of more contacts 34 are fully crimped, the wall between the two crimping stations 86 and 102, identified as 110, begins to deflect toward the right and is forced against a support surface 114 or side of the crimping blade 70, as viewed in FIG. 5. When the inserter 48 is retracted the pressure tending to deflect the wall 110 to the right is no longer countered by the first crimping blade 70, so the wall deflects. When the connector housing 36 is advanced to the next position, as shown in FIG. 5A, the deflected wall 110 intrudes somewhat into the contact cavity in the second station 102. However, when another insulated conductor 32 is positioned in the first crimping station 88 and the tool is again actuated so that the inserter 48 is again moved toward the base 44, the angled camming surface 96 on the second crimping blade 88 allows the second crimping blade 88 to enter the contact cavity in the second crimping station 102 and cam the wall 110 toward the left, as viewed in FIG. 5A. Concurrently, the insertion blade 66 inserts the insulated conductor into the contact 34 in the first crimping station and the first crimping blade 70 rolls over and partially crimps the tabs 76 while the second crimping blade completes the crimping of the tabs 76 of the contact in the second crimping station 102. Again, that final crimping of the contact in the second crimping station causes the crimped contact to bulge outwardly against the wall 108 between the first and second crimping blades, identified as 112, forcing it against the support surface 114 of the first crimping blade 70. As the inserter 48 is again withdrawn, the wall 112 deflects similarly to the wall 110, the connector housing 36 is advance to the next position, and the process repeated until all of the desired contacts 34 have been terminated to insulated conductors 32.

While the present invention has been described with respect to the hand tool 30 it will be appreciated by those skilled in the art that the teachings of the present invention can be advantageously utilized in power assisted tools, bench machines, and automated machines that terminate insulated conductors to IDC contacts. Further, while the second crimping blade 88 is shown attached to the inserter 48, it will be understood that the second crimping blade may be completely separate from the inserter 48 and may be attached to its own shank adjacent to the inserter.

An important advantage of the present invention is that insulated conductors can be terminated to IDC connectors having multiple closely spaced contacts in a housing having relatively thin walls separating the contacts, while assuring that the inserter does not damage the walls of the connector housing.

I claim:

1. In an apparatus for terminating a plurality of insulated conductors to a plurality of insulation displacement contacts arranged side by side in an insulating connector housing having a wall between each two adjacent contacts, each contact including tabs to be crimped onto the insulation of a respective one of said plurality of insulated conductors thereby forming a strain relief, tooling for performing said termination comprising:

(a) a first member in a first station for at least partially inserting a first insulated conductor of said plurality of insulated conductors into a first contact of said plurality of contacts and for only partially crimping said tabs of said first contact onto the insulation of said first insulated conductor;

(b) means for moving said connector housing so that said first contact and said first insulated conductor are moved to a second station and a second contact of said plurality of contacts and associated second insulated conductor of said plurality of insulated conductors are moved into said first station; and (c) a second member in said second station for engaging and further crimping said partially crimped tabs of said first contact.

2. The apparatus according to claim 1 wherein said first member is arranged to insert said second insulated conductor into said second contact and to only partially crimp said tabs of said second contact onto said insulation of said second insulated conductor in said first station concurrently with said further crimping of said first contact in said second station.

3. The apparatus according to claim 1 wherein said second member is attached to and carried by said first member.

4. The apparatus according to claim 1 wherein said first member includes a support surface arranged to engage and support said wall between said first and second contacts during said further crimping of said first contact.

5. The apparatus according to claim 4 wherein said first member includes a first portion arranged to insert said conductor into said contact and a second portion having a first crimping surface adjacent said support surface for effecting said partial crimping of said tabs, said first and second portions being of unitary construction.

6. The apparatus according to claim 5 wherein said second member includes a second crimping surface for effecting said further crimping, and a camming surface adjacent said second crimping surface for engaging and deflecting a said wall opposite said wall between said first and second contacts in a direction away from said first member.

7. The apparatus according to claim 1 wherein said first member in said first station is arranged to effect full insertion of said first insulated conductor into said first contact during said only partially crimping of said tabs of said first contact onto said insulation of said first insulated conductor.

8. A tool for terminating a plurality of insulated conductors to a plurality of insulation displacement contacts arranged side by side in an insulating connector housing having a wall between each two adjacent contacts, each contact including tabs to be crimped onto the insulation of a respective one of said plurality of insulated conductors thereby forming a strain relief, said tool comprising:

(a) a frame;

(b) a base attached to said frame having a track for guiding and positioning said connector housing;

(c) a ram coupled to said frame and arranged to undergo movement toward and away from said base;

(d) an actuator for effecting said movement of said ram upon operation of said actuator; and (e) tooling responsive to said operation of said actuator for performing said termination by inserting said insulated conductor into said contact and only partially crimping said tabs in a first station and for further crimping said tabs in a second station adjacent said first station.

9. The tool according to claim 8 including locating means for positioning said connector housing on said track so that a desired contact is in said first station in alignment with said tooling.

10. The tool according to claim 9 wherein said locating means comprises a locating member spring biased in a first direction in locating engagement with a portion of said connector housing, said locating member having first and second opposed angled camming surfaces which straddle and engage opposite edges of said portion of said connector housing.

11. The tool according to claim 10 wherein said locating member includes a third angled camming surface arranged to engage another portion of said connector housing and move said locating member in a second direction opposite said first direction out of said locating engagement with said connector housing when said connector housing is moved along said track to position a desired contact in said first station.

12. The tool according to claim 8 wherein said tooling includes:

(a) a first member in said first station for at least partially inserting a first said insulated conductor into a first said contact and for only partially crimping said tabs of said first contact onto said insulation of said first insulated conductor;

(b) means for moving said connector housing so that said first contact and said first insulated conductor are moved to a second station and a second contact and associated second insulated conductor are moved into said first station; and (c) a second member in said second station for engaging and further crimping said partially crimped tabs of said first contact.

13. The tool according to claim 12 wherein said first member is arranged to insert said second insulated conductor into said second contact and to only partially crimp said tabs of said second contact onto said insulation of said second insulated conductor in said first station concurrently with said further crimping of said first contact in said second station.

14. The tool according to claim 12 wherein said first member in said first station is arranged to effect full insertion of said first insulated conductor into said first contact during said only partially crimping of said tabs of said first contact onto said insulation of said first insulated conductor.

15. The tool according to claim 12 wherein said first member includes a support surface arranged to engage and support said wall between said first and second contacts during said further crimping of said first contact.

16. The tool according to claim 15 wherein said first member includes a first portion arranged to insert said conductor into said contact and a second portion having a first crimping surface adjacent said support surface for effecting said partial crimping of said tabs, said first and second portions being of unitary construction.

17. The tool according to claim 16 wherein said second member includes a second crimping surface for effecting said further crimping, and a camming surface adjacent said second crimping surface for engaging and deflecting a said wall opposite said wall between said first and second contacts in a direction away from said first member.

* * * * *